United States Patent [19]

Westmoreland, Jr.

[11] 3,970,316

[45] July 20, 1976

[54] GOLF SWING RESTRICTOR

[75] Inventor: James P. Westmoreland, Jr., Los Angeles, Calif.

[73] Assignee: Diversified Products, Inc., Wichita, Kans.

[22] Filed: June 30, 1975

[21] Appl. No.: 591,485

Related U.S. Application Data

[63] Continuation-in-part of Ser. No. 562,653, March 27, 1975, abandoned.

[52] U.S. Cl. ..... 273/189 R; 128/134

[51] Int. Cl.[2] ..... A63B 69/36

[58] Field of Search ..... 128/134; 273/188, 189, 273/190, 183 B

[56] References Cited

UNITED STATES PATENTS

| | | | |
|---|---|---|---|
| 2,808,267 | 10/1957 | Heaton | 273/189 R |
| 2,809,042 | 10/1957 | Wasley | 273/189 AX |
| 3,324,851 | 6/1967 | Posner | 273/189 R X |
| 3,419,277 | 12/1968 | Martin | 273/189 R |
| 3,474,781 | 10/1969 | Gaylord | 128/134 |

*Primary Examiner*—George J. Marlo

*Attorney, Agent, or Firm*—Blakely, Sokoloff, Taylor & Zafman

[57] ABSTRACT

A restrictor for controlling the swing of a golfer which includes elastic arm and chest encircling bands. The bands are joined such that they abut, and in one embodiment the upper edge of the band defines an acute angle.

7 Claims, 13 Drawing Figures

Fig. 1
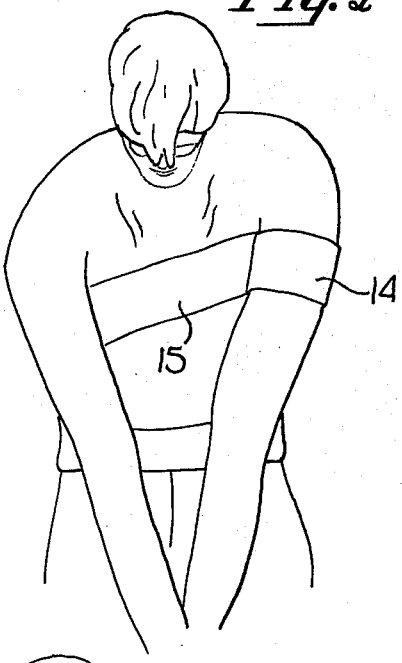
Fig. 2
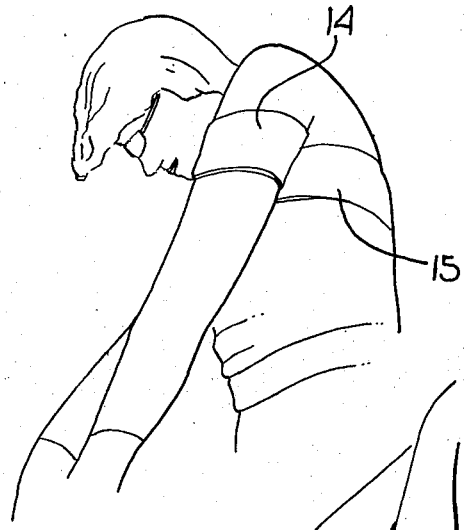
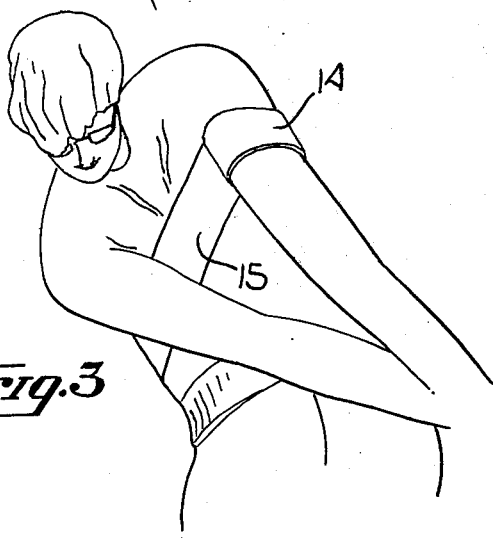
Fig. 3
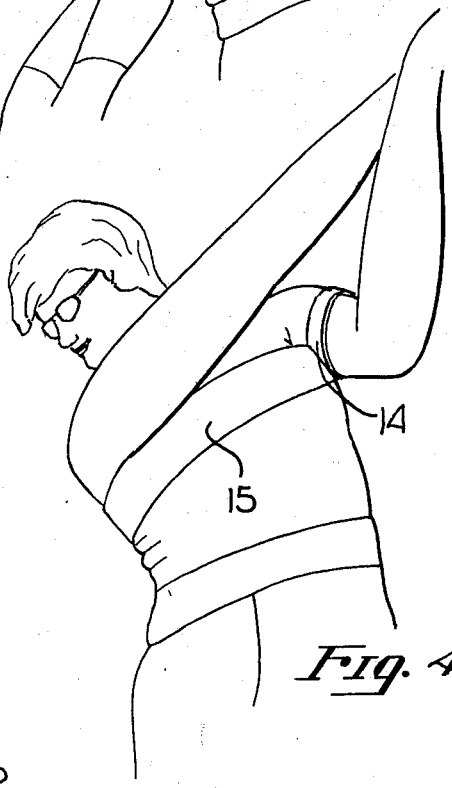
Fig. 4
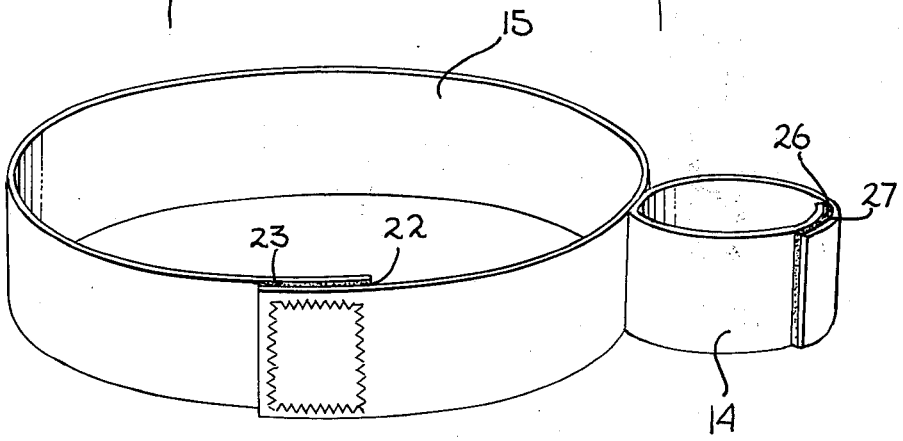
Fig. 5

Fig. 6
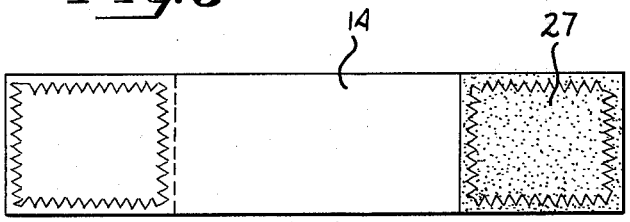
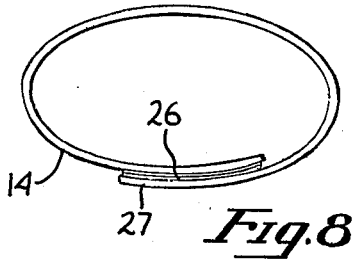
Fig. 8
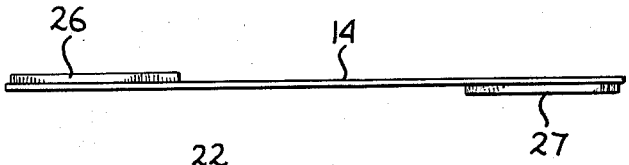
Fig. 7
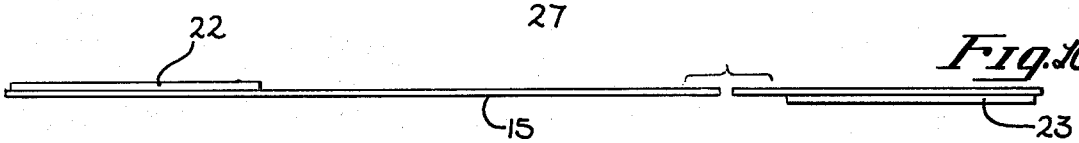
Fig. 10
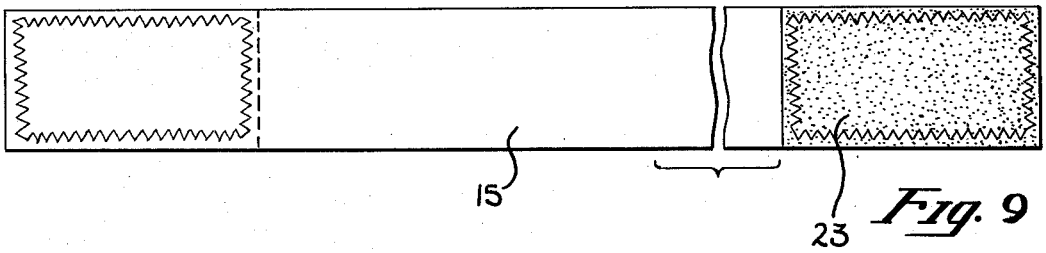
Fig. 9
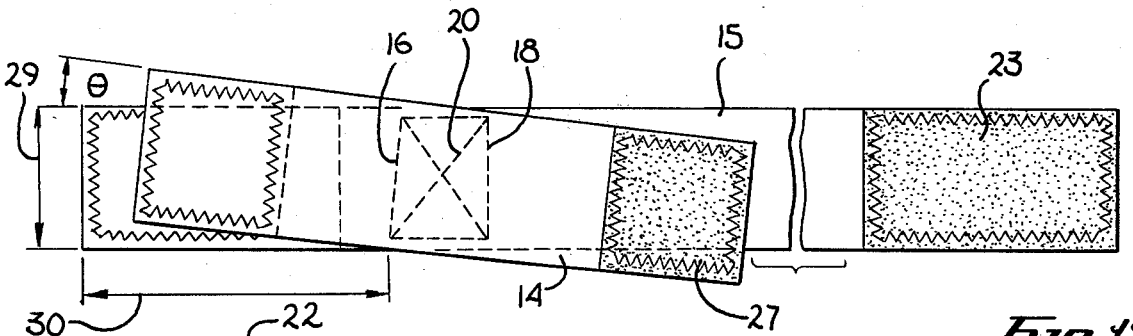
Fig. 11
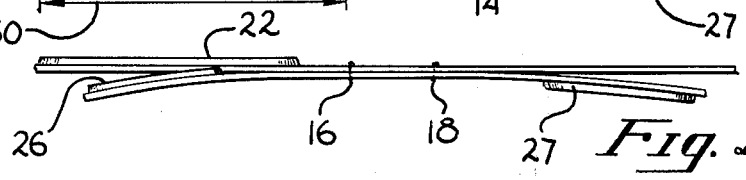
Fig. 12
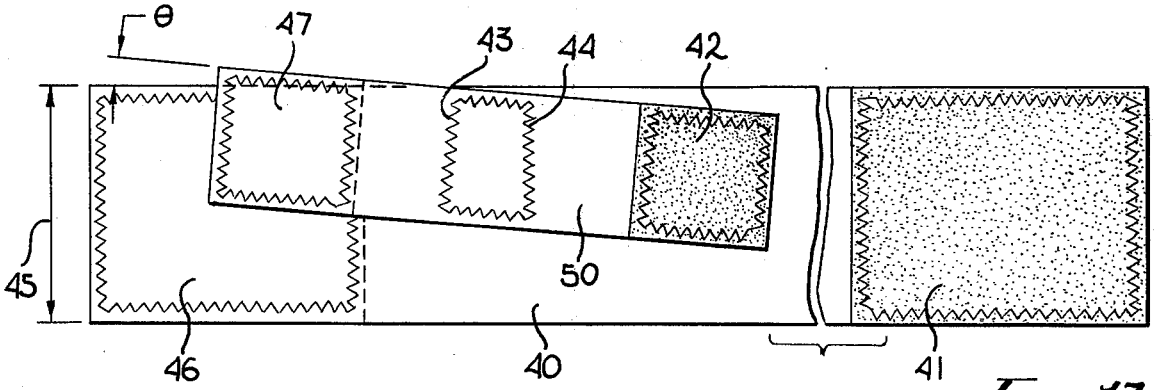
Fig. 13

GOLF SWING RESTRICTOR

Prior Application

This is a continuation-in-part application of Ser. No. 562,653 filed on Mar. 27, 1975, now abandoned.

Background of the Invention

1. Field of the Invention

The invention relates to the field of golfing aids.

2. Prior Art

In order to properly play golf, it is necessary to accurately control the movement and positioning of the leading arm and/or trailing arm during a golf stroke. Proper control and positioning is necessary both for the back swing and downward swing of the stroke. An example of one of many possible problems is that some golfers tend to pick up the club rather than swinging it back.

Numerous golfing aids are known in the prior art for improving the swing. In one device an anchor strap is disposed about the shoulder opposite the shoulder of the leading arm. This strap is connected to an arm band disposed about the leading arm through a back strap. This device at best limits the extent of the back swing, but provides little or no help in coordinating the leading arm to body movement, particularly during the downward swing.

In another device, a golf harness is disclosed which includes a chest belt and a pair of arm belts. This harness unnecessarily restricts movement of both arms; moreover, it is unsightly and cumbersome. Yet another device is relatively complex and cannot be concealed beneath a shirt or the like.

As will be seen, the present invention provides a golf swing restrictor which may be manufactured inexpensively, is easy to engage, and which may be concealed beneath a shirt or the like. The restrictor to the present invention greatly assists a golfer in properly addressing the ball by coordinating leading or trailing arm and body movement.

SUMMARY OF THE INVENTION

An apparatus for controlling the swing of a golfer is disclosed which includes an elastic chest encircling band of approximately 3 inches in width for encircling the chest of a golfer. An elastic arm encircling band for engaging the leading or trailing arm of a golfer is sewn to the chest encircling band such that the two bands abut. In the presently preferred embodiment "Velcro" fasteners are used on both the chest and arm encircling bands in order that the bands may be readily placed about the chest and arm. In one embodiment the upper edges of the chest encircling band and arm encircling band define an acute angle of approximately 10°, thereby assuring that the leading or trailing arm is in the proper position relative to the remainder of the golfer's body.

BRIEF DESCRIPTION OF THE DRAWINGS

FIGS. 1 through 4 illustrate the golf restrictor of the present invention worn by a golfer during various positions of a golf stroke.

FIG. 1 illustrates a golfer as he initially addresses the ball prior to the back swing.

FIG. 2 illustrates a golfer at approximately the point at which the club strikes the ball.

FIG. 3 illustrates a golfer in a position after the ball has been struck.

FIG. 4 illustrates the end of the stroke.

FIG. 5 is a perspective view of the golf restrictor of the present invention.

FIG. 6 is a plan view of the arm encircling band.

FIG. 7 is a top view of the arm encircling band of FIG. 6.

FIG. 8 illustrates the arm encircling band of FIGS. 6 and 7 formed in a generally circular shape.

FIG. 9 is a plan view of the chest encircling band.

FIG. 10 is a top view of the chest encircling band of FIG. 9.

FIG. 11 is a plan view illustrating the arm and chest encircling bands, when joined to form the golf restrictor of the present invention.

FIG. 12 is a partial top view of the golf restrictor of FIG. 11.

FIG. 13 is a plan view of an alternate embodiment of the golf restrictor of FIGS. 5 through 12, this embodiment being particularly suitable for women.

DETAILED DESCRIPTION OF THE INVENTION

In the present invention a restrictor for use by a golfer is described. In FIG. 5 the invented restrictor is shown as including a chest encircling band 15 and an arm encircling band 14. As shown in FIGS. 6 through 8 the arm encircling band 14 incudes an elongated elastic band of sufficient length to encircle the arm of a golfer. In the presently preferred embodiment the band 14 is approximately 3 inches in width. Fastening means are disposed on the opposite ends of the band in order that the band may be readily fastened about the leading or trailing arm of a golfer. Hooks, snaps, buttons, zippers or other fastening means may be utilized; however, in the presently preferred embodiment the fastening means comprises a plurality of eyes 27 and a section of pile 26 which are sewn on opposite surfaces of the band 14. This type of fastener is commercially available and sold under the trademark "Velcro".

In FIGS. 9 and 10 the chest encircling band 15 is illustrated, and includes an elongated elastic band of sufficient length to encircle the chest of a golfer. In the presently preferred embodiment the band is approximately 3 inches in width (for men) as shown by dimension 29 of FIG. 11. Fastening means are also utilized on the chest encircling band so that the band may be readily fastened about the chest of a golfer. While other fastening means, such as buttons, zippers, snaps, etc., may be utilized, again the "Velcro" fastener is utilized as shown by the pad of pile 23 sewn to one end and one surface of band 15, and a pad of hooks 22 sewn to the other end and other surface of band 15.

In FIGS. 11 and 12 the bands 14 and 15 are shown sewn together along seams 16 and 18, and along cross seams 20. As may be seen in FIG. 5, the arm encircling band and chest encircling band are abutting, and in the presently preferred embodiment seams 16 and 18 are spaced apart for a distance of approximately 2¾ inches at their lower ends and approximately 2½ inches at their upper ends. The bands 14 and 15 are sewn together such that their upper edges define an acute angle which in the presently preferred embodiment is approximately 10°. Also in the presently preferred embodiment dimension 30 of FIG. 11 is approximately 7¼ inches.

In the presently preferred embodiment the chest encircling band and the arm encircling band are elastic only along its length, with the bands comprising 63% cotton, 26% Rayon and 11% rubber.

In FIG. 13 an alternate embodiment of the restrictor is shown and includes a chest encircling band 40 having a pad of pile 41 disposed at one end and a pad of hooks 46 disposed at the other end. An arm encircling band 50 is sewn to the chest encircling band 40 at seams 43 and 44, and again forms an acute angle of approximately 10°. The arm encircling band includes a pad of pile 42 and a pad of hooks 47. In this embodiment the fastening means also comprises "Velcro" fasteners. The embodiment of FIG. 13 is substantially the same as the embodiment discussed in conjunction with FIGS. 5 through 12, except that the width of the chest encircling band, shown as dimension 45, is approximately 6 inches. This chest encircling band is more suitable for women, whereas the embodiment shown in FIGS. 5 through 12 is more adaptable for men.

To use the restrictor, the chest encircling band is placed about the chest as shown in FIGS. 1 through 4 such that the arm encircling band may engage the leading or trailing arm of a golfer. Note that the band must be turned such that the acute angle formed between the edges of the chest encircling band and arm encircling band allows the leading or trailing arm of the golfer to hang inwardly as shown in FIG. 1. The chest encircling band passes over the latissimus dorsi muscle disposed beneath the leading or trailing arm of the golfer, while the arm encircling band encircles the tricep and bicep muscles of the arm.

It has been found that once the belt is worn golfers tend to form a single unit or arm from the top of the golfer's shoulder to the sole of the club. The golfer as shown in FIG. 1 (use on leading arm shown) should bow slightly at the waist, slightly bend his knees with his feet no wider apart than his shoulder width to achieve maximum balance, then drop his right shoulder and arm while initially addressing the ball. In use the restrictor when worn on either arm forces a golfer to have a more coordinated golf stroke, and particularly controls the movement of the leading and trailing arm relative to the remainder of the body when the restrictor is worn on either arm. The elastic nature of the bands provides sufficient freedom, yet restricts undesirable movements. The restrictor keeps the golfer in the proper place, and helps assures that the golfer hits through the ball and not to the ball.

It will be noted that the embodiment of the restrictor shown in FIGS. 5 through 12 may be used on either arm simply by turning the restrictor over since the acute angle between the arm band and chest band will then be properly aligned for either arm.

The embodiment shown in FIG. 13 which is particularly adaptable for women and is used in a similar manner to the embodiment of FIGS. 5 through 12; however, a separate restrictor may be used for the leading and trailing arm to obtain the proper acute angle alignment.

Thus, a golf restrictor has been disclosed which includes numerous improvements over the prior art and which is inexpensive to manufacture, easy to use and which provides excellent results.

I claim:

1. An apparatus for controlling the swing of a golfer comprising:

an elongated, elastic chest encircling band for encircling a chest, said band including an inner surface for engaging such chest and an outer surface, and said band including fastening means for securing said chest encircling band about such chest; and an elastic arm encircling band for encircling an arm, said arm encircling band including an inner surface for engaging such arm and an outer surface, said arm encircling band including fastening means for fastening said arm encircling band about such arm, said arm encircling band being directly joined to said chest encircling band such that a portion of said outer surface of said arm encircling band is in direct contact with a portion of said outer surface of said chest encircling band;

whereby the swing of a golfer is controlled and coordinated with the movement of the golfer's body since the upper portion of the golfer's arm is held by said arm encircling band adjacent to the golfer's chest.

2. The apparatus defined by claim 1 wherein said direct joinder of said arm encircling band and chest encircling band forms a fixed acute angle between the upper edge of said arm encircling band and the upper edge of said chest encircling band.

3. The apparatus defined by claim 2 wherein said acute angle is 10°.

4. The apparatus defined by claim 1 wherein said fastening means of said chest encircling band, and said fastening means of said arm encircling band comprise "Velcro" fasteners.

5. The apparatus defined by claim 1 wherein said chest encircling band is six inches wide whereby said apparatus is particularly suited for women golfers.

6. The apparatus defined by claim 1 wherein said chest encircling bans is three inches wide.

7. The apparatus defined by claim 1 wherein said arm encircling band is sewn to said chest encircling band at a pair of spaced-apart seams to achieve said direct contact.

* * * * *